US010436500B2

(12) United States Patent
Jo et al.

(10) Patent No.: US 10,436,500 B2
(45) Date of Patent: Oct. 8, 2019

(54) REFRIGERATOR

(71) Applicant: Samsung Electronics Co., Ltd., Suwon-si, Gyeonggi-do (KR)

(72) Inventors: Yeon Jin Jo, Suwon-si (KR); Byeong Soo Kim, Seoul (KR); Cheol Woong Seo, Seoul (KR); Hyun-Il Lee, Seoul (KR); Sang Woon Jeon, Seoul (KR); June Hyuck Choi, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 8 days.

(21) Appl. No.: 15/824,969

(22) Filed: Nov. 28, 2017

(65) Prior Publication Data

US 2018/0149415 A1 May 31, 2018

(30) Foreign Application Priority Data

Nov. 30, 2016 (KR) ..... 10-2016-0162042

(51) Int. Cl.
*F25D 23/06* (2006.01)
*F25D 25/02* (2006.01)
*F25D 25/04* (2006.01)

(52) U.S. Cl.
CPC ..... *F25D 23/069* (2013.01); *F25D 23/062* (2013.01); *F25D 25/021* (2013.01);
(Continued)

(58) Field of Classification Search
CPC .... F25D 23/069; F25D 23/062; F25D 25/021; F25D 25/025; F25D 25/04;
(Continued)

(56) References Cited

U.S. PATENT DOCUMENTS 2,239,484 A * 4/1941 Cocks ..... A47F 3/0486 220/532
2,281,489 A * 4/1942 Fritz ..... F25D 23/069 220/529
(Continued)

FOREIGN PATENT DOCUMENTS

JP 03091681 A * 4/1991 ..... F25D 25/025
JP 10197141 A * 7/1998 ..... F25D 25/025
(Continued)

*Primary Examiner* — Hanh V Tran

(57) ABSTRACT

Disclosed herein is a refrigerator having dividers movable in the left-right direction to efficiently use the internal space of a container and enabling a tray or a shelf used in the fridge room to be used in the freezer room as well by preventing the gap between the dividers from narrowing to a certain distance or less to put the tray on the dividers. A refrigerator includes a main body, a storage compartment formed inside the main body with an open front, a door configured to open and close the open front of the storage compartment, a container contained in the storage compartment to store groceries therein, and a plurality of dividers arranged to be movable inside the container in the left-right direction and dividing the internal space of the container, wherein the divider includes pinion gears configured to guide movement of the divider along guide rails arranged on the front and rear walls of the container, a fixer configured to fix the divider to prevent movement of the divider, and a gap maintaining bar configured to prevent the gap between the dividers from narrowing to a certain distance or less.

15 Claims, 11 Drawing Sheets

(52) U.S. Cl.
CPC ..... *F25D 25/025* (2013.01); *F25D 25/04* (2013.01); *F25D 2325/021* (2013.01); *F25D 2331/812* (2013.01)

(58) Field of Classification Search
CPC ..... F25D 2325/021; F25D 2331/812; A47B 2210/17; A47B 2210/175
USPC ..... 312/348.3
See application file for complete search history.

(56) References Cited

U.S. PATENT DOCUMENTS 2,711,944 A * 6/1955 Meek ..... F25D 25/025 292/18
4,305,217 A * 12/1981 Green ..... B42F 21/00 220/535
4,735,324 A * 4/1988 Wilcek ..... A47F 5/005 211/184
4,909,406 A * 3/1990 Wu ..... A45C 7/00 220/528
5,312,180 A * 5/1994 Tieder ..... A47B 88/90 220/534
5,651,596 A * 7/1997 Carlson ..... A47B 88/90 220/533
5,806,941 A * 9/1998 Diederich ..... B42F 17/14 220/542
8,733,867 B2 * 5/2014 Hwang ..... F25D 25/025 312/402
8,875,538 B2 * 11/2014 Lee ..... F25D 23/02 62/389
10,006,693 B2 * 6/2018 Ramm ..... F25D 25/025
2002/0171344 A1 * 11/2002 Hollenstein ..... A47B 88/90 312/348.3
2003/0184198 A1 * 10/2003 Bodingbauer ..... A47B 88/90 312/348.3
2004/0178708 A1 * 9/2004 O'Halloran ..... F25D 23/069 312/404
2005/0160854 A1 * 7/2005 Rotter ..... F25D 25/025 74/422
2007/0247037 A1 * 10/2007 Schenker ..... A47B 88/00 312/223.6
2008/0258593 A1 * 10/2008 Berger ..... A47B 88/90 312/348.3
2009/0188275 A1 * 7/2009 Lintker ..... A47F 3/0439 62/446
2010/0319391 A1 * 12/2010 Lim ..... F25D 25/025 62/441
2012/0047939 A1 * 3/2012 Junge ..... F25D 17/065 62/441
2013/0099651 A1 * 4/2013 Hwang ..... F25D 25/025 312/404
2013/0221824 A1 * 8/2013 Jeon ..... F25D 23/00 312/404
2014/0152166 A1 * 6/2014 Baum ..... F25D 25/025 312/404
2014/0265802 A1 * 9/2014 Wilcox ..... F25D 25/025 312/404
2014/0298854 A1 10/2014 Junge et al.
2014/0312758 A1 * 10/2014 Gossens ..... F25D 23/04 312/404
2015/0028026 A1 * 1/2015 Rajasekaran ..... F25D 25/025 220/4.03
2015/0069066 A1 * 3/2015 Choi ..... F25D 25/022 220/533
2015/0198364 A1 * 7/2015 Mok ..... F25D 25/025 62/407
2016/0153704 A1 * 6/2016 Burke ..... F25D 25/025 312/404
2016/0265816 A1 * 9/2016 Gillette ..... F25D 25/025

FOREIGN PATENT DOCUMENTS

JP 2000009378 A * 1/2000 ..... F25D 23/04
JP 2004-340545 A 12/2004
JP 2006010249 A * 1/2006 ..... F25D 25/022
JP 2010078300 A * 4/2010 ..... A23B 7/01
JP 2015-38410 A 2/2015
KR 10-2015-0062662 A 6/2015

* cited by examiner

REFRIGERATOR

CROSS-REFERENCE TO RELATED APPLICATION AND CLAIM OF PRIORITY

This application is related to and claims priority to Korean Patent Application No. 10-2016-0162042 filed on Nov. 30, 2016, the contents of which are incorporated herein by reference.

TECHNICAL FIELD

The present disclosure relates to a refrigerator with dividers for dividing internal space of a container.

BACKGROUND

Refrigerators are devices having a storage compartment and a cold air supply for supplying cold air into the storage compartment to keep groceries fresh.

Temperatures in the storage compartment remain within a certain range required to keep the groceries fresh.

The storage compartment has an open front, which is shut by a door at ordinary times to maintain the temperature of the storage compartment.

The storage compartment is divided into a top chamber, a middle chamber, and a bottom chamber. The top chamber is used as a fridge room, the middle chamber is used as an adjustable temperature room, and the bottom chamber is used as a freezer room.

The top chamber used as the fridge room is opened and closed by a French door split into two pieces pivotally combined with the main body, and the middle chamber used as the adjustable temperature room and the bottom chamber used as the freezer room are opened and closed by slidable drawer-type doors.

A container is coupled with the back of the drawer-type door that slides in the front-back direction to be pulled into and pulled out from the storage compartment, and the internal space of the container is divided into multiple compartments by at least one divider.

However, since the divider to divide the internal space of the container is usually fixed in the container, it is not possible to efficiently use the internal space of the container depending on the types of food to be contained in the container.

SUMMARY

To address the above-discussed deficiencies, it is a primary object to provide a refrigerator having dividers movable in the left-right direction to efficiently use the internal space of a container and enabling a tray or a shelf used in the fridge room to be used in the freezer room as well by preventing the gap between the dividers from narrowing to a certain distance or less to put the tray on the dividers.

In accordance with one aspect of the present disclosure, a refrigerator includes a main body, a storage compartment formed inside the main body with an open front, a door configured to open and close the open front of the storage compartment, a container contained in the storage compartment to store groceries therein, and a plurality of dividers arranged to be movable inside the container in the left-right direction and dividing the internal space of the container, wherein the divider includes pinion gears configured to guide movement of the divider along guide rails arranged on the front and rear walls of the container, a fixer configured to fix the divider to prevent movement of the divider, and a gap maintaining bar configured to prevent the gap between the dividers from narrowing to a certain distance or less.

The storage compartment may be equipped with at least one tray to store food, and the tray may be put on top of the dividers with the gap maintained by the gap maintaining bar.

The dividers may comprise a first divider and a second divider, and the pinion gears may comprise first pinion gears arranged on the front of the first and second dividers and second pinion gears arranged on the back of the first and second dividers, and the first pinion gears and the second pinion gears may be connected by rotation shafts.

The rotation shafts run through the insides of the first and second dividers to connect the first and second pinion gears, and the first and second dividers each may comprise a pair of supporters to rotationally support the rotation shaft.

The gap maintaining bar may comprise a first gap maintaining bar arranged in the first divider and a second gap maintaining bar arranged in the second divider.

The first maintaining bar may comprise a first coupler coupled with a pair of supporters arranged on the first divider and a first extension extending from the first coupler in the left-right direction of the container.

The second maintaining bar may comprise a second coupler coupled with a pair of supporters arranged on the second divider and a second extension extending from the second coupler in the left-right direction of the container.

The first extension extends toward the second divider and the second extension extends toward the first divider, and if the first and second dividers are moved in the left-right direction until the first and second extensions come into contact, the first and second extensions may prevent the gap between the first and second dividers from no further narrowing.

The fixer may comprise a fixing button arranged in an upper portion of the divider to be vertically movable, an anti-rotation unit arranged on the fixing button to prevent rotation of the rotation shaft, a fixing hook arranged in the divider to fix the fixing button, and a fixing hole formed in the fixing button to be fixed to the fixing hook.

The fixing hole may comprise a first fixing hole and a second fixing hole, and the first fixing hole may be located above the second fixing hole.

A cutting area may be formed by cutting into a square pillar shape at a position corresponding to the anti-rotation unit of the rotation shaft.

Once the fixing button has been moved upward, the anti-rotation unit may be positioned above the cutting area to be separated from the cutting area, enabling the rotation shaft to be able to rotate and enabling the divider to be moved in the left-right direction.

Once the fixing button has been moved upward, the fixing hook may be fixed in the second fixing hole, preventing movement of the fixing button.

If the fixing button is moved downward, the anti-rotation unit is moved downward and comes into contact with the cutting area, and once the anti-rotation unit comes into contact with the cutting area, rotation of the rotation shaft may be prevented, thereby preventing movement of the divider.

Once the fixing button has been moved downward, the fixing hook may be fixed in the first fixing hole, preventing movement of the fixing button.

In accordance with another aspect of the present disclosure, a refrigerator includes a main body, a storage compartment formed inside the main body with an open front, a door configured to open and close the open front of the storage compartment, a container contained in the storage compartment to store groceries therein, a plurality of dividers arranged to divide the internal space of the container and having a pair of pinion gears configured to roll along guide rails arranged on the front and back walls of the container to be movable in the left-right direction of the container and a rotation shaft connecting the pair of pinion gears, and a fixer configured to fix the divider to prevent movement of the divider by preventing rotation of the rotation shaft.

The fixer may comprise a fixing button arranged in an upper portion of the divider to be vertically movable, an anti-rotation unit arranged on the fixing button to prevent rotation of the rotation shaft, a fixing hook arranged in the divider to fix the fixing button that has been vertically moved, and a fixing hole formed in the fixing button to be fixed to the fixing hook.

Further may include a gap maintaining bar configured to prevent the gap between the dividers from narrowing to a certain distance or less, wherein the gap maintaining bar maintains the gap between the dividers to be able to hold a tray on top of the dividers to store food.

In accordance with still another aspect of the present disclosure, a refrigerator includes a main body, a storage compartment formed inside the main body with an open front, a door configured to open and close the open front of the storage compartment, a container contained in the storage compartment to store groceries therein, a plurality of dividers arranged to be movable inside the container in the left-right direction and dividing the internal space of the container, and a gap maintaining bar configured to prevent the gap between the dividers from narrowing to a certain distance or less, wherein the gap maintaining bar maintains the gap to enable a tray arranged to store food to be put on top of the dividers in the storage compartment.

The gap maintaining bar may be arranged on each of the plurality of dividers to prevent the gap between the dividers from no further narrowing by coming into contact with another gap maintaining bar if the gap between the dividers narrows to a certain distance or less.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
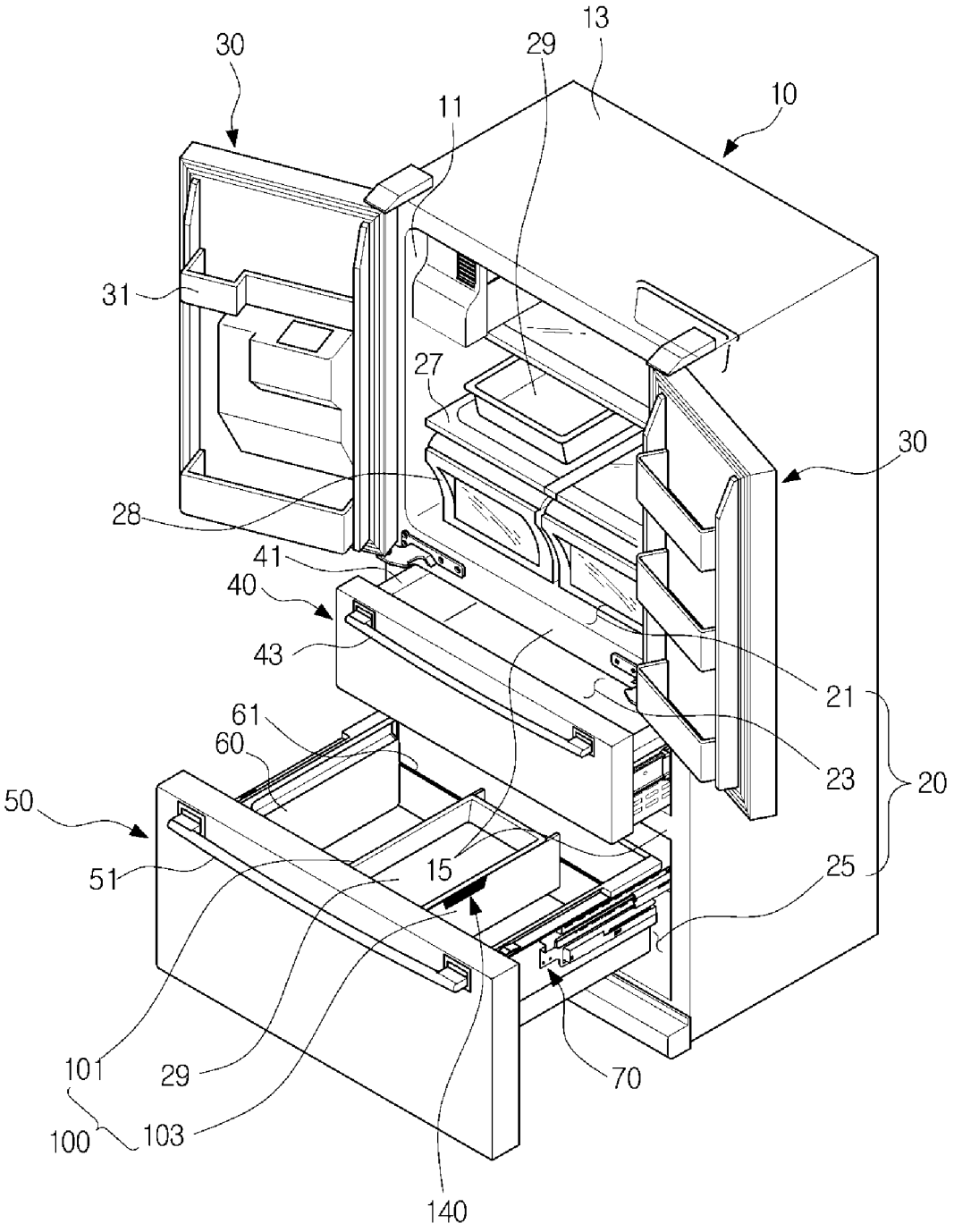
FIG. 1 is a perspective view of a refrigerator, according to an embodiment of the present disclosure.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

In general, refrigerators may be classified by types based on the form of storage compartments and doors.

There may be top mounted freezer (TMF) typed refrigerators in which a storage compartment is partitioned by a horizontal partition wall into upper and lower sections with a freezer formed in the upper section and a fridge formed in the lower section, and bottom mounted freezer (BMF) typed refrigerators in which a fridge is formed in the upper section and a freezer is formed in the lower section.

Furthermore, there may be side by side (SBS) typed refrigerators in which a storage compartment is partitioned by a vertical partition wall into left and right sections with a freezer formed in one section and a fridge formed in the other section, and French door refrigerator (FDR) typed refrigerators in which a storage compartment is partitioned by a horizontal partition wall into upper and lower sections with a fridge formed in the upper section and a freezer formed in the lower section.

In embodiments of the present disclosure, the FDR typed refrigerator will now be focused for convenience of explanation, but embodiments of the present disclosure are not limited to the FDR typed refrigerators.

Embodiments of the present disclosure will now be described in detail with reference to accompanying drawings.

FIG. 1 is a perspective view of a refrigerator, according to an embodiment of the present disclosure.

Referring to FIG. 1, a refrigerator may include a main body 10, a plurality of storage compartments 20 arranged inside the main body 10 with the open front, doors 30, 40, 50 to open and close the open front of the storage compartments 20, and containers 41, 60 combined with the rear side of the drawer type doors 40, 50 to be pulled into and pulled out from the storage compartments 20 along with the drawer type doors 40, 50.

The main body 10 may include an inner casing 11 forming the storage compartments 20, an outer casing 13 forming the exterior, and a cold air supply (not shown) for supplying cold air to the storage compartments 20.

The cold air supply may include a compressor (not shown), a condenser (not shown), an expansion valve (not shown), an evaporator (not shown), a blower fan (not shown), a cold air duct (not shown), etc., and there may be an insulation (not shown) foamed between the inner casing 11 and the outer casing 13 of the main body 10 to prevent the cold air from leaking out from the storage compartments 20.

A machine room where the compressor for compressing refrigerants and the condenser for condensing the compressed refrigerants are installed may be contained in a rear bottom portion of the main body 10.

The storage compartments 20 are divided by partition walls 15 into multiple sections including a top section 21, a middle section 23, and a bottom section 25 from top to bottom, each section keeping groceries cool or frozen as required.

The top section 21 may be formed as a fridge room, and equipped with a plurality of shelves 27 dividing the top section 21 into multiple compartments, and with at least one container 28 and tray 29 to store groceries or some other items.

The doors 30, 40, 50 to open and close the storage compartments 20 may include French doors 30 pivotally combined with the main body 10 to open and close the open front of the top section 21, and drawer type doors 40, 50 sliding in and out from the middle section 23 and the bottom section 25.

The top section 21 may be opened and closed by the French doors 30 pivotally combined with the main body 10, and a plurality of door guards 31 may be installed on the rear side of the French doors 30 to contain groceries.

The middle section 23 and the bottom section 25 may be formed as a adjustable temperature section and a freezer section, respectively, and may be opened and closed by the drawer type doors 40, 50, respectively, that are slidable against the main body 10.

Although the top section 21, the middle section 23, and the bottom section 25 are shown to be formed as the fridge section, the adjustable temperature section, and the freezer section, respectively, the present disclosure is not limited thereto.

A container 41 may be combined with the rear side of the drawer type door 40 that opens and closes the middle section 23, and the front of the drawer type door 40 has a handle 43 to be gripped by the user to pull in or pull out the container 41 from the middle section 23 along with the drawer type door 40.

A container 60 may be combined with the rear side of the drawer type door 50 that opens and closes the bottom section 25, and the front of the drawer type door 50 has a handle 51 to be gripped by the user to pull in or pull out the container 60 from the bottom section 25 along with the drawer type door 50.

The containers 41, 60 may be integrally formed with the drawer type doors 40, 50, respectively.

The containers 41, 60 may be slidably pulled into and pulled out from the middle section 23 and the bottom section 25 by a sliding device 70.

The internal space of the containers 41, 60 may be divided by a plurality of dividers 100 into multiple compartments, and an example of the dividers 100 dividing the container 60 pulled into and pulled out from the bottom section 25 will now be explained in the following description.

Figure 2:
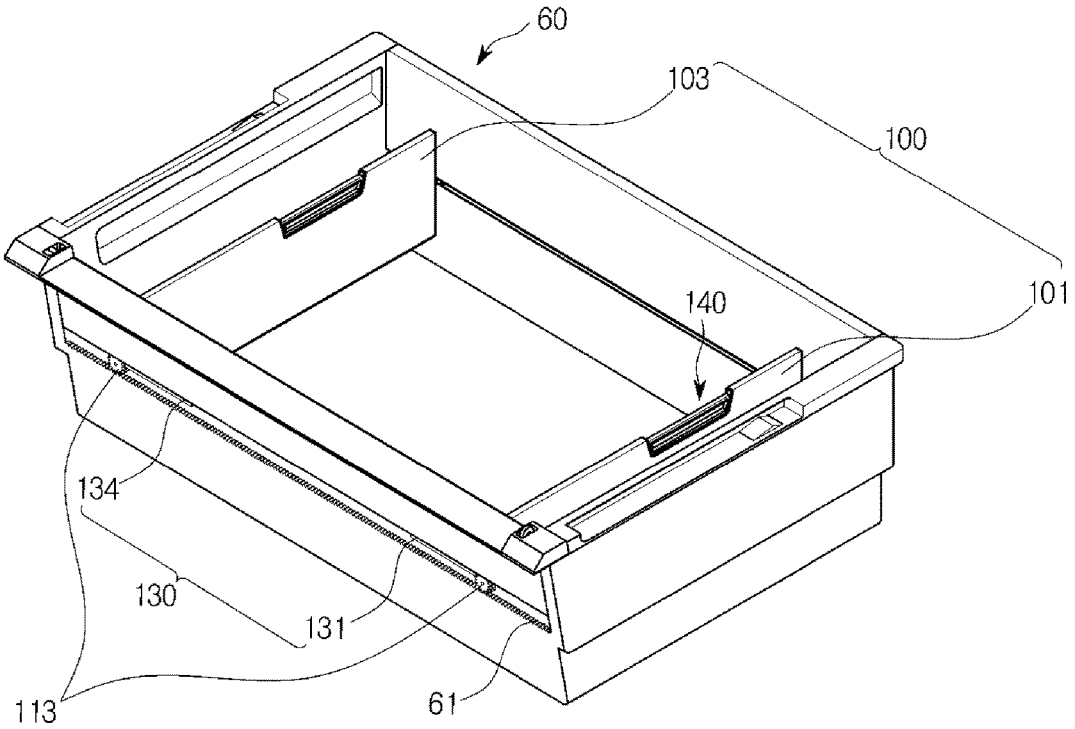
FIG. 2 is a perspective view of a container with the internal space divided by dividers, according to an embodiment of the present disclosure.
Figure 3:
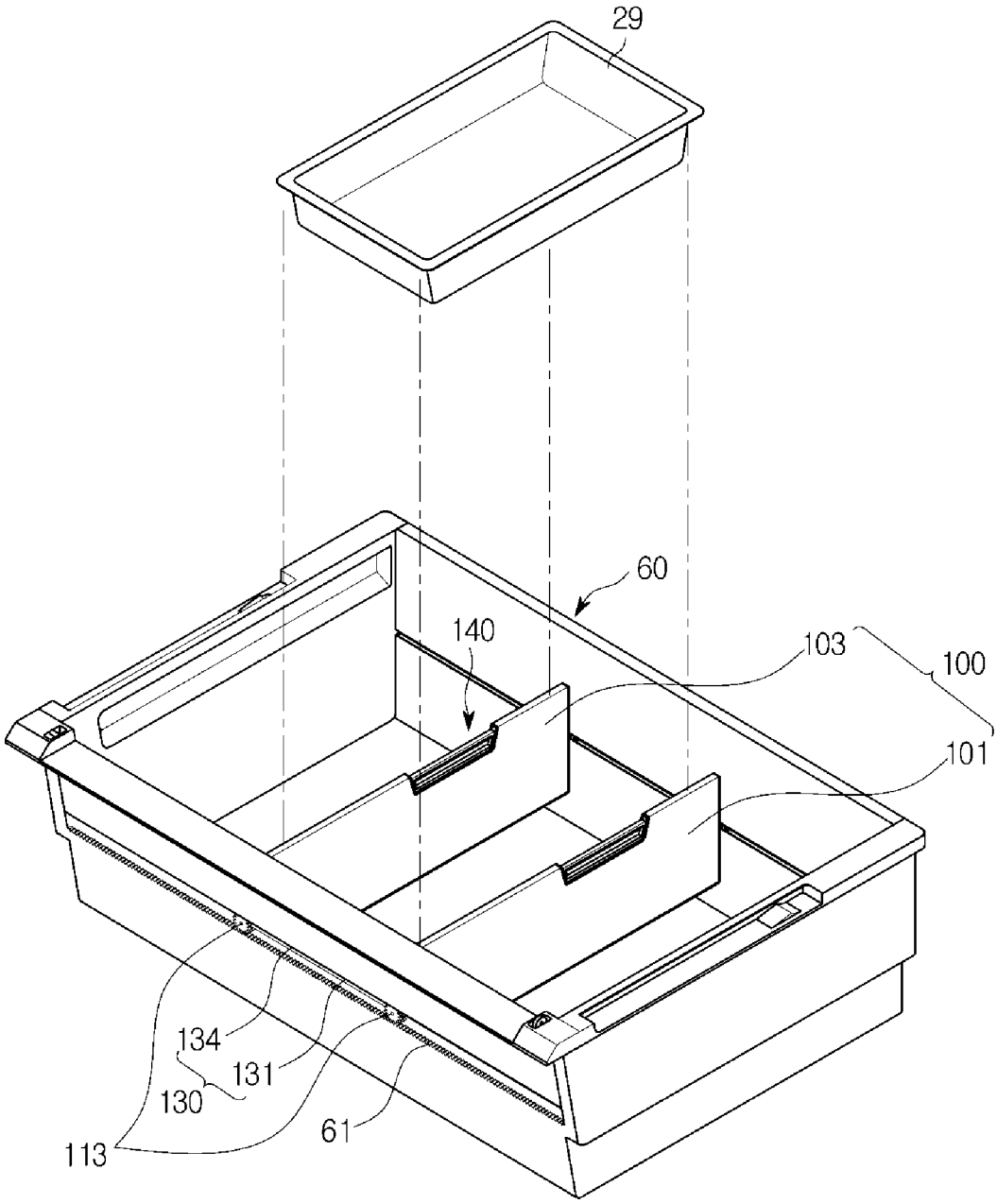
FIG. 3 shows a tray that is putting on dividers, according to an embodiment of the present disclosure.
Figure 4:
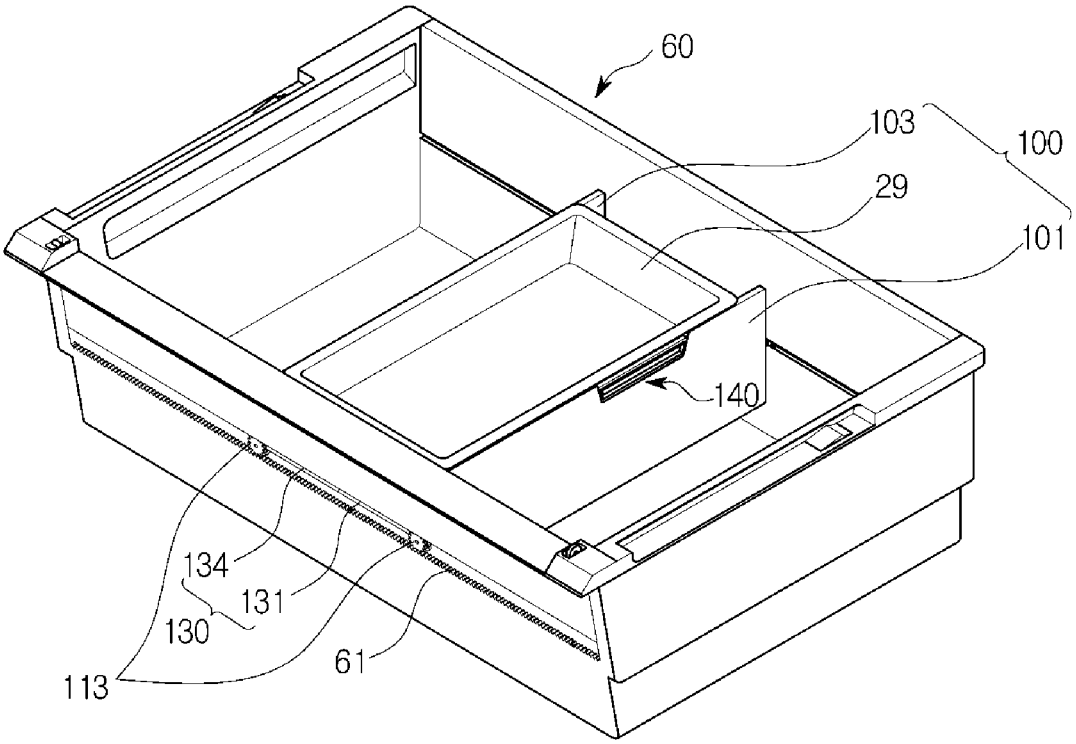
FIG. 4 shows a tray that has been put on dividers, according to an embodiment of the present disclosure.
Figure 5:
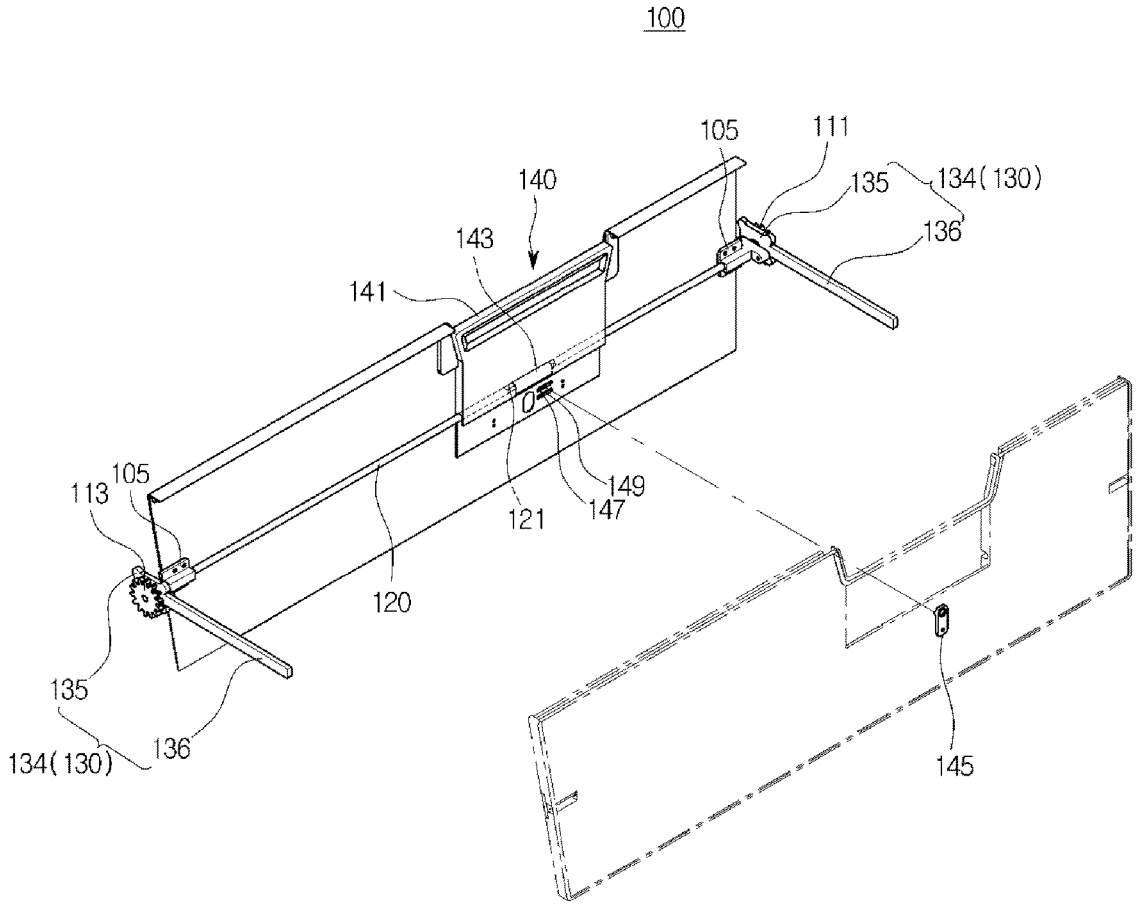
FIG. 5 shows dividers, according to an embodiment of the present disclosure.
Figure 6:
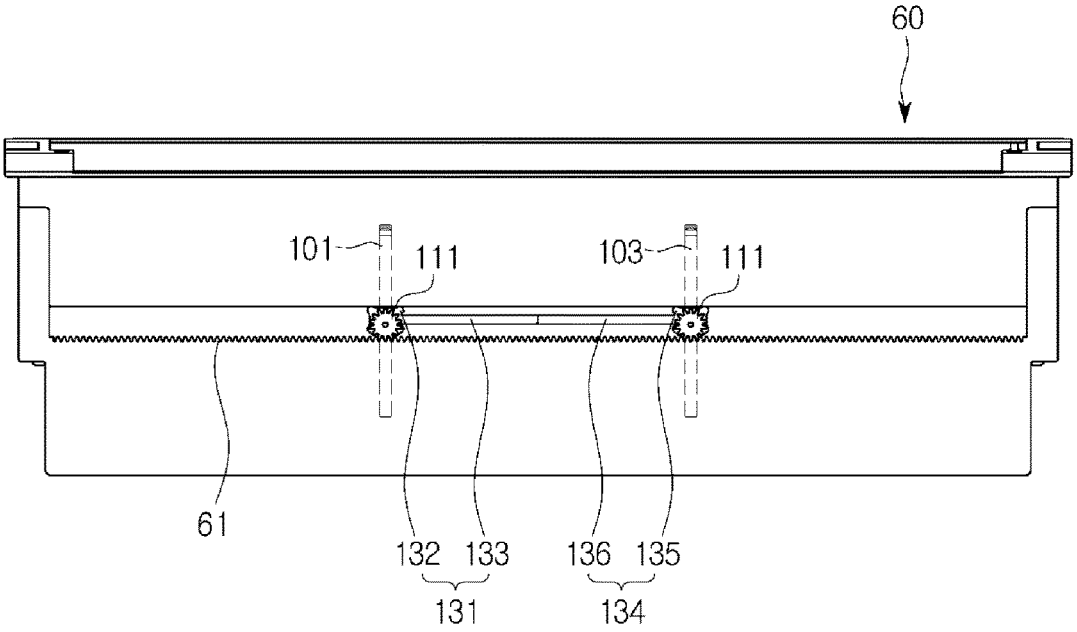
FIG. 6 shows dividers with the gap maintained by a gap maintaining bar that prevents the gap from narrowing to a certain distance or less, according to an embodiment of the present disclosure.

FIG. 2 is a perspective view of a container with the internal space divided by dividers, according to an embodiment of the present disclosure, FIG. 3 shows a tray that is putting on dividers, according to an embodiment of the present disclosure, FIG. 4 shows a tray that has been put on dividers, according to an embodiment of the present disclosure, FIG. 5 shows dividers, according to an embodiment of the present disclosure, and FIG. 6 shows dividers with the gap maintained by a gap maintaining bar that prevents the gap from narrowing to a certain distance or less, according to an embodiment of the present disclosure.

Referring to FIGS. 2 to 5, the internal space of the container 60 is divided into multiple compartments by the plurality of dividers 100.

The dividers 100 may include a first divider 101 and a second divider 103, which are movable in the left-right direction inside the container 60.

Although the dividers 100 are shown to include the first and second dividers 101 and 103, they are not limited thereto but may include two or more dividers.

Guide rails 61 are arranged on the front and rear walls of the container 60 for the dividers 100 to be movable in the left-right direction.

The guide rails 61 may have a structure to be engaged with pinion gears 110 of the dividers 100, as will be described below, in order for the pinion gears 110 to be rolled along the guide rails 61.

The divider 100 may include the pinion gears 110 for guiding movement of the divider 100 along the guide rails 61 arranged on the container 60 in the left-right direction, a rotation shaft 120 connecting the pinion gears 110, a gap maintaining bar 130 for preventing the gap between the dividers 100 from narrowing to a certain distance or less, and a fixer 140 for fixing the divider 100 to prevent movement of the divider 100.

The pinion gears 110 are formed to be engaged with the guide rails 61 to roll along the guide rails 61, enabling the divider 100 to move in the left-right direction in the internal space of the container 60.

The pinion gears 110 may include first pinion gears 111 arranged on the front of the first and second dividers 101 and 103, and second pinion gears 113 arranged on the back of the first and second dividers 101 and 103.

The first pinion gears 111 arranged on the front of the first and second dividers 101 and 103 move by rolling along the guide rails 61 arranged on the front wall of the container 60, and the second pinion gears 113 arranged on the back of the first and second dividers 101 and 103 move by rolling along the guide rails 61 arranged on the rear wall of the container 60.

The rotation shaft 120 runs through each of the first and second dividers 101 and 103 to connect the first and second pinion gears 111 and 113, and is rotationally supported by a pair of supporters 105 and rotated with the first and second pinion gears 111 and 113.

The rotation shaft 120 includes a cutting area 121 positioned to correspond to an anti-rotation unit 143 of a fixer 140 which will be described below, and the cutting area 121 is formed in the shape of a square pillar.

Figure 7:
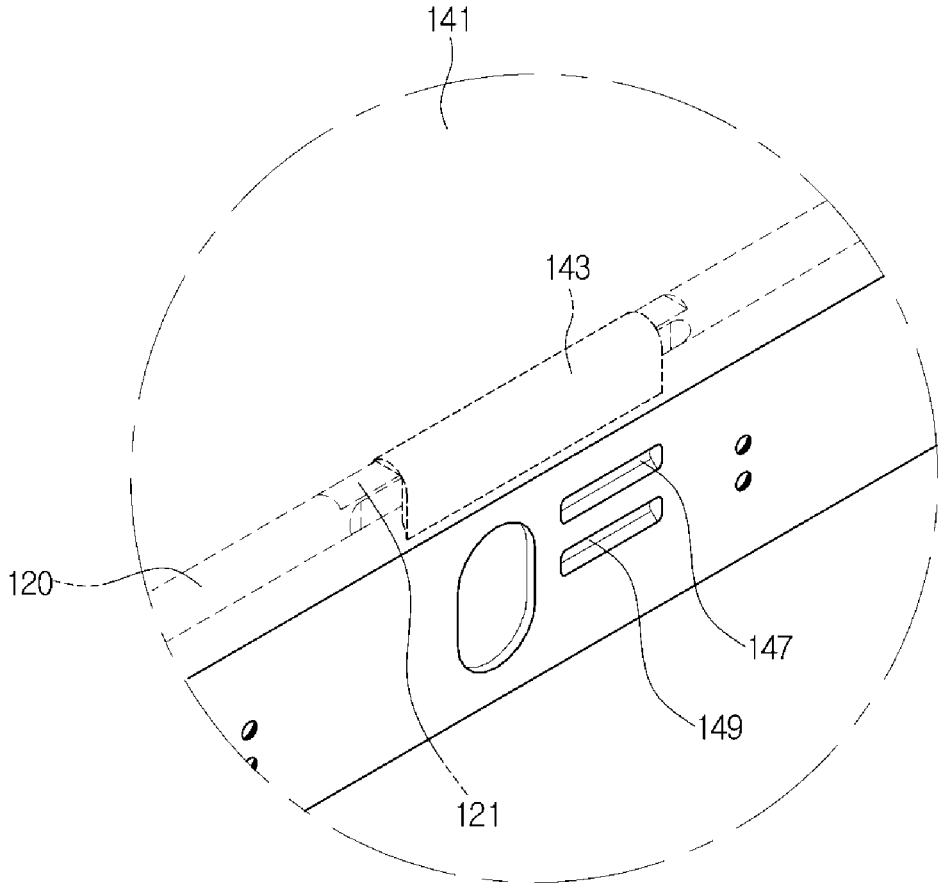
FIG. 7 shows an anti-rotation unit of a fixer, and a cutting area of a rotation shaft, according to an embodiment of the present disclosure.

The cutting area 121 and the anti-rotation unit 143 are formed to have corresponding shapes, so if the anti-rotation unit 143 comes into contact and is engaged with the cutting area 121, rotation of the rotation shaft 120 is prevented by the anti-rotation shaft 143, thereby preventing movement of the divider 100 (see FIG. 7).

The gap maintaining bar 130 to prevent the gap between the first and second dividers 101 and 103 from narrowing to a certain distance or less includes first gap maintaining bars 131 arranged on the front and back of the first divider 101 and second gap maintaining bars 134 arranged on the front and back of the second dividers 103.

The first gap maintaining bars 131 may include first couplers 132 coupled with the pair of supporters 105 arranged on the first divider 101, and first extensions 133 extending in the left-right direction of the container 60 from the first couplers 132.

The second gap maintain bars 134 may include second couplers 135 coupled with the pair of supporters 105 arranged on the second divider 103, and second extensions 136 extending in the left-right direction of the container 60 from the second couplers 135.

The first extensions 133 arranged on the first divider 101 extend from the first divider 101 toward the second divider 103, and the second extensions 136 extend from the second divider 103 toward the first divider 101.

Since the first and second extensions 133 and 136 extend to each other, as shown in FIG. 6, when the first and second dividers 101 and 103 move to each other in the left-right direction while narrowing the gap between them, the first and second extensions 133 and 136 come into contact with each other.

As shown in FIGS. 3 and 6, when the first and second extensions 133 and 136 come into contact with each other, further movement of the first and second dividers 101 and 103 toward each other is prevented and the gap between the first and second dividers 101 and 103 no longer narrows.

As shown in FIG. 4, when the gap between the first and second dividers 101 and 103 no longer narrows, the gap between the first and second dividers 101 and 103 may afford to hold the tray 29, so the tray 29 contained in the top section 21, which is the fridge section, may be used in the bottom section 25, the freezer section, as well.

That is, the gap maintaining bar 130 maintains the gap between the first and second dividers 101 and 103 to hold the tray 29 on top of the dividers 100.

Although the tray 29 is shown to be put on top of the dividers 100, the shelf 27 usually contained in the top section 21, the fridge section, may also be put on top of the dividers 100 instead of the tray 29 by adjusting the gap between the first divider 101 and the second divider 103 through the gap maintaining bar 130.

FIG. 7 shows an anti-rotation unit of a fixer, and a cutting area of a rotation shaft, according to an embodiment of the present disclosure.

Referring to FIGS. 5 and 7, the fixer 140 is arranged on the upper portion of the divider including the first and second dividers 101 and 103.

The fixer 140 fixes the divider 100 to prevent rotation of the rotation shaft 120.

The fixer 140 may include a fixing button 141 arranged in the upper portion of the divider 100 to be movable in the vertical direction, the anti-rotation unit 143 arranged on the fixing button 141 to prevent rotation of the rotation shaft 120, a fixing hook 145 arranged on the divider 100 to fix the fixing button 141, and fixing holes 147, 149 formed in the fixing button 141 to catch the fixing hook 145 to be fixed.

The fixing button 141 is arranged to run through the upper portion of the divider 100, and to be movable in the vertical direction. If the fixing button 141 is moved in the vertical direction, the anti-rotation unit 143 and the fixing holes 147, 149 arranged in the fixing button 141 are moved along with the fixing button 141 in the vertical direction.

The anti-rotation unit 143 is arranged at a position corresponding to the cutting area 121 of the rotation shaft 120 and has the form corresponding to the shape of the cutting area 121. With this structure, if the anti-rotation unit 143 comes into contact with the cutting area 121 and is engaged with the cutting area 121, rotation of the rotation shaft 120 is prevented by the anti-rotation unit 143.

Once the rotation of the rotation shaft 120 is prevented, movement of the divider 100 in the left-right direction is prevented and at this point, the divider 100 is fixed.

The fixing hook 145 is arranged at a position corresponding to the fixing holes 147, 149 in the divider 100.

Once the fixing hook 145 is caught in the fixing holes 147, 149, vertical movement of the fixing button 141 with the fixing holes 147, 149 formed therein is prevented, so the fixing button 141 that has been moved in the vertical direction is then fixed.

The fixing holes 147, 149 includes a first fixing hole 147 and a second fixing hole 149, and the first fixing hole is located above the second fixing hole 149.

Next, referring to FIGS. 8 to 11, operation of the fixer 140 fixing the divider 100 will now be described in detail.

Figure 8:
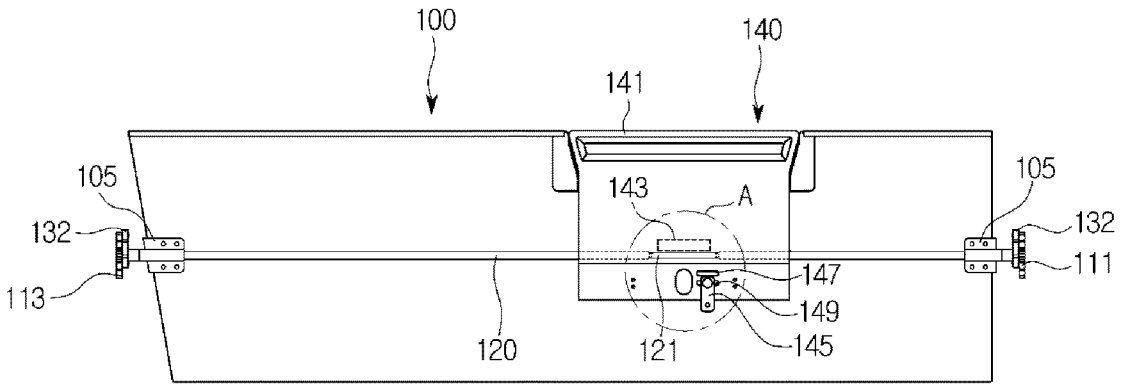
FIG. 8 shows a state in which a divider is not fixed by a fixer, according to an embodiment of the present disclosure.
Figure 9:
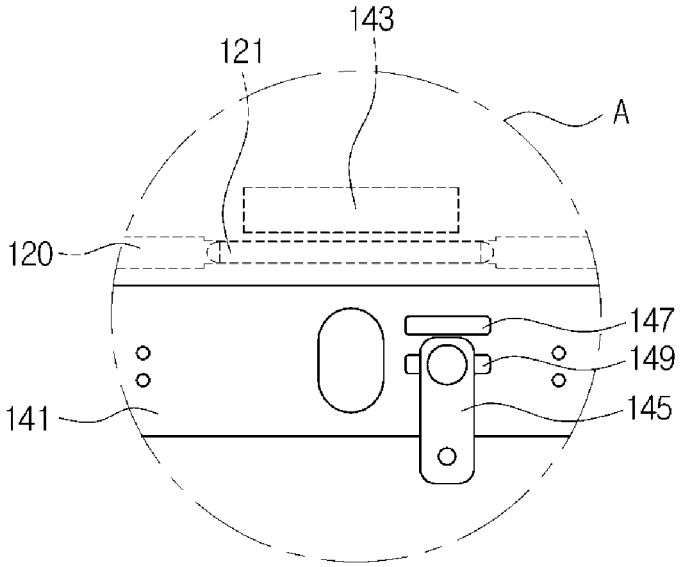
FIG. 9 is an enlarged view of portion A of FIG. 8.
Figure 10:
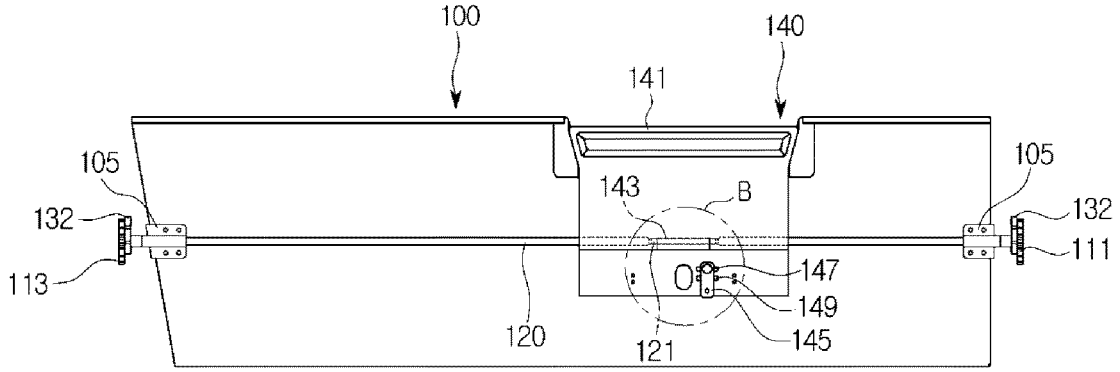
FIG. 10 shows a state in which a divider is fixed by a fixer, according to an embodiment of the present disclosure.
Figure 11:
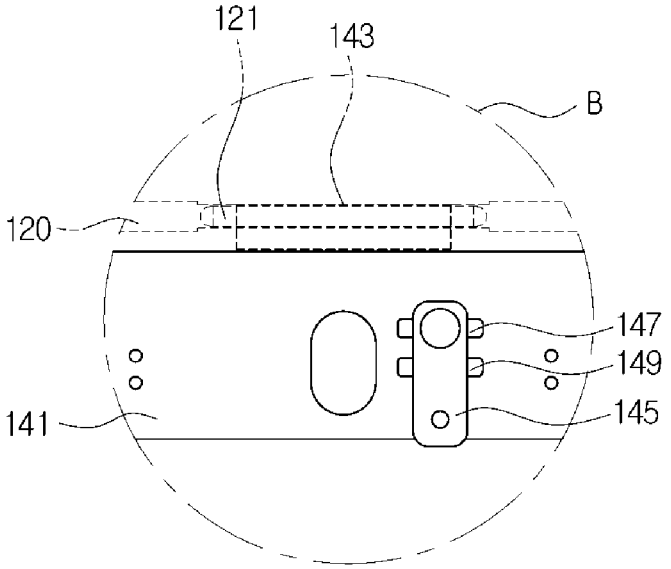
FIG. 11 is an enlarged view of portion B of FIG. 10.

FIG. 8 shows a state in which a divider is not fixed by a fixer, according to an embodiment of the present disclosure, FIG. 9 is an enlarged view of portion A of FIG. 8, FIG. 10 shows a state in which a divider is fixed by a fixer, according to an embodiment of the present disclosure, and FIG. 11 is an enlarged view of a part B of FIG. 10.

Referring to FIGS. 8 and 9, once the fixing button 141 has been moved upward, the anti-rotation unit 143 arranged on the fixing button 141 is separated from and located above the cutting area 121 formed in the rotation shaft 120.

While the anti-rotation unit 143 and the cutting area 121 are separated, the rotation shaft is able to rotate, so the divider 100 may be freely moved in the left-right direction.

In this case, the fixing hook 145 is caught in the second fixing hole 149, preventing vertical movement of the fixing button 141.

When the divider 100 is at a desired position by moving it in the left-right direction, the user may press the fixing button 141 to move the fixing button 141 downward.

Once the fixing button 141 is moved downward, the anti-rotation unit 143 arranged on the fixing button 141 is moved downward along with the fixing button 141, coming into contact with the cutting area 121 formed in the rotation shaft 120.

When the anti-rotation unit 143 comes into contact with the cutting area 121 and is engaged with the cutting area 121, rotation of the rotation shaft 120 is prevented, so the divider 100 may not be able to move in the left-right direction.

In this case, the fixing hook 145 is caught in the first fixing hole 147, preventing vertical movement of the fixing button 141.

According to embodiments of the present disclosure, internal space of a container may be efficiently used, and a tray or a shelf used in the fridge room may be used in the freezer room as well by enabling the tray or shelf to be put on dividers that divide the internal space of the container of the freezer.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body;

a storage compartment formed inside the main body with an open front;

a door configured to open and close the open front of the storage compartment;

a container contained in the storage compartment to store groceries therein; and a plurality of dividers arranged to be movable inside the container in a left-right direction and dividing an internal space of the container, wherein each of the plurality of the dividers comprises:

a pair of pinion gears configured to guide movement of the divider along guide rails arranged on front and rear walls of the container;

a rotation shaft connecting the pair of pinion gears;

a fixer configured to fix the divider to prevent movement of the divider by preventing rotation of the rotation shaft; and a gap maintaining bar configured to maintain a gap between the plurality of dividers at a predetermined distance during the left-right direction movement of the plurality of dividers, wherein the gap maintaining bar maintains the gap to enable a tray arranged to store food to be put on top of the dividers in the storage compartment.

2. The refrigerator of claim 1, wherein the gap maintaining bar is provided on each of the plurality of dividers and is configured to maintain the gap between the plurality of dividers by making a contact with each other.

3. The refrigerator of claim 1, wherein the plurality of dividers comprise a first divider and a second divider, and the pinion gears comprise first pinion gears arranged on a front of the first and second dividers and second pinion gears arranged on a back of the first and second dividers, and the first pinion gears and the second pinion gears are connected by rotation shafts.

4. The refrigerator of claim 3, wherein the rotation shafts run through insides of the first and second dividers to connect the first and second pinion gears, and the first and second dividers each comprises a pair of supporters to rotationally support the rotation shaft.

5. The refrigerator of claim 4, wherein the gap maintaining bar comprises a first gap maintaining bar arranged on the first divider and a second gap maintaining bar arranged on the second divider.

6. The refrigerator of claim 5, wherein the first gap maintaining bar comprises a pair of first couplers coupled with a pair of supporters arranged on the first divider and a pair of first extensions extending from the pair of first couplers in the left-right direction of the container.

7. The refrigerator of claim 6, wherein the second gap maintaining bar comprises a pair of second couplers coupled with a pair of supporters arranged on the second divider and a pair of second extensions extending from the pair of second couplers in the left-right direction of the container.

8. The refrigerator of claim 7, wherein the pair of first extensions extends toward the second divider and the pair of second extensions extends toward the first divider, and if the first and second dividers are moved in the left-right direction until the pairs of first and second extensions come into contact, the pairs of first and second extensions prevent the gap between the first and second dividers from further narrowing.

9. The refrigerator of claim 3, wherein the fixer comprises a fixing button arranged in an upper portion of a divider to be vertically movable, an anti-rotation unit arranged on the fixing button to prevent rotation of the rotation shaft, a fixing hook arranged on the divider to fix the fixing button, and a fixing hole formed in the fixing button to be fixed to the fixing hook.

10. The refrigerator of claim 9, wherein the fixing hole comprises a first fixing hole and a second fixing hole, and the first fixing hole is located above the second fixing hole.

11. The refrigerator of claim 10, wherein a cutting area is formed by cutting into the rotation shaft a square pillar shape at a position corresponding to the anti-rotation unit of the fixing button.

12. The refrigerator of claim 11, wherein once the fixing button has been moved upward, the anti-rotation unit is positioned above the cutting area to be separated from the cutting area, enabling the rotation shaft to be able to rotate and enabling the divider to be moved in the left-right direction.

13. The refrigerator of claim 12, wherein once the fixing button has been moved upward, the fixing hook is fixed in the second fixing hole, allowing movement of the fixing button.

14. The refrigerator of claim 13, wherein if the fixing button is moved downward, the anti-rotation unit is moved downward and comes into contact with the cutting area, and once the anti-rotation unit comes into contact with the cutting area, rotation of the rotation shaft is prevented, thereby preventing movement of the divider.

15. The refrigerator of claim 14, wherein once the fixing button has been moved downward, the fixing hook is fixed in the first fixing hole, preventing movement of the fixing button.

* * * * *